US006283277B1

(12) United States Patent
Smith et al.

(10) Patent No.: US 6,283,277 B1
(45) Date of Patent: Sep. 4, 2001

(54) SELF-PROPELLED, MOBILE ARTICULATED TRAMMING HAULAGE CONVEYOR SYSTEM FOR MINING OPERATIONS

(75) Inventors: Gregory W. Smith, Hurricane; Frank N. Kent, Nitro; William J. Peters, Winfield, all of WV (US)

(73) Assignee: Amvest Systems? Inc., Charlottesville, VA (US)

( * ) Notice: Subject to any disclaimer, the term of this patent is extended or adjusted under 35 U.S.C. 154(b) by 0 days.

(21) Appl. No.: 09/354,207

(22) Filed: Jul. 15, 1999

Related U.S. Application Data

(60) Provisional application No. 60/093,187, filed on Jul. 17, 1998.

(51) Int. Cl.[7] ..... B65G 21/00

(52) U.S. Cl. ..... 198/861.2; 198/303

(58) Field of Search ..... 198/861.2, 300, 198/303, 860.1, 319, 318, 589, 330, 733

(56) References Cited

U.S. PATENT DOCUMENTS

| | | | | |
|---|---|---|---|---|
| 3,395,940 | | 8/1968 | Young et al. | 299/56 |
| 3,730,593 | | 5/1973 | Karlovsky, Jr. | 299/76 |
| 3,762,532 | | 10/1973 | Nelson | 198/117 |
| 3,782,536 | | 1/1974 | Toney | 198/233 |
| 4,040,669 | | 8/1977 | Franklin | 299/56 |
| 4,047,761 | | 9/1977 | Coupe | 299/64 |
| 4,068,755 | | 1/1978 | Parkes et al. | 198/557 |
| 4,120,535 | | 10/1978 | Delli-Gatti, Jr. | 299/18 |
| 4,133,582 | | 1/1979 | Kogelmann | 299/64 |
| 4,160,619 | | 7/1979 | Nelson | 414/501 |
| 4,277,105 | | 7/1981 | Taylor | 299/64 |
| 4,332,317 | | 6/1982 | Bähre et al. | 198/734 |
| 4,387,798 | | 6/1983 | Jamison et al. | 198/587 |
| 4,773,528 | | 9/1988 | Anderson et al. | 198/861.2 |
| 4,784,257 | | 11/1988 | Doerr | 198/594 |
| 4,844,238 | | 7/1989 | Lachner | 198/861.2 |
| 4,865,184 | | 9/1989 | Bodimer | 198/861.2 |
| 4,957,405 | | 9/1990 | Roberts et al. | 414/339 |
| 5,096,048 | * | 3/1992 | Lachner et al. | 198/733 |
| 5,112,111 | | 5/1992 | Addington et al. | 299/18 |
| 5,129,502 | | 7/1992 | Justice | 198/303 |
| 5,232,269 | | 8/1993 | Addington et al. | 299/67 |
| 5,261,729 | | 11/1993 | Addington et al. | 299/64 |
| 5,348,130 | | 9/1994 | Thomas | 198/312 |
| 5,364,171 | | 11/1994 | Addington et al. | 299/18 |
| 5,427,439 | | 6/1995 | Herickhoff | 299/64 |
| 5,513,728 | | 5/1996 | Alberni et al. | 188/71.7 |
| 5,513,902 | | 5/1996 | Pago et al. | 299/1.6 |
| 5,634,545 | * | 6/1997 | Plumley | 198/303 |
| 5,667,279 | | 9/1997 | Christopher et al. | 299/1.9 |
| 5,709,433 | | 1/1998 | Christopher et al. | 299/30 |
| 5,810,447 | | 9/1998 | Christopher et al. | 299/30 |
| 5,848,825 | | 12/1998 | Antoline et al. | 299/18 |
| 5,938,289 | | 8/1999 | Antoline et al. | 299/67 |

* cited by examiner

*Primary Examiner*—Kenneth W. Noland
(74) *Attorney, Agent, or Firm*—Jenkens & Gilchrist, P.C.

(57) ABSTRACT

A self-propelled, mobile articulated tramming haulage conveyor system includes a continuous series of individual cascading mined material haulage conveyors located over one or more long continuous chain, conveyor system tramming apparatus or flexible crawlers. For negotiation of corners or bends in a borehole, the frame on which the continuous chain, conveyor system tramming system is mounted is flexible.

16 Claims, 9 Drawing Sheets

SELF-PROPELLED, MOBILE ARTICULATED TRAMMING HAULAGE CONVEYOR SYSTEM FOR MINING OPERATIONS

This patent application claims the benefits of an earlier U.S. Provisional Patent Application No. 60/093,187 which was filed Jul. 17, 1998.

FIELD

The present invention pertains to conveyor systems used in mining operations; more particularly, the present invention pertains to tramming haulage conveyor systems used to transport mined substances.

BACKGROUND

In mining operations, especially underground mining operations, such as coal mining or the like, conveyors or a series of conveyors are often used to transport the mined material out of the mine. Typically, there is a main conveyor that moves the mined material along a fixed path. Such main conveyor has a terminal end at a fixed location for receiving the material being transported out of the mine.

In the past, shuttle cars or other short distance haulage vehicles have been used to transport the mined material from the mining machine to the fixed terminal end of the main conveyor. The use of shuttle cars and other such haulage vehicles is, at best, intermittent, time consuming, and inefficient. Thus, in more recent years, there have been several developments directed toward the use of a mobile articulated conveyor system. In contrast to shuttle cars, a mobile articulated conveyor system provides for continuous transport of the mined material produced by a continuous mining machine along a conveyor as the continuous mining machine both advances into the mine face and changes the direction of its forward movement. Mobile articulated conveyor systems are particularly adaptable to "room and pillar" type coal mining operations, wherein the mobile articulated conveyor system follows the continuous mining machine and changes the direction of its travel as the continuous mining machine penetrates into the mine face in one room and then is backed out and set to work at the mine face in another room.

An early example of an articulated conveyor system appears in U.S. Pat. No. 4,332,317 (Bähre, et al.) assigned to Klockner-Werke AG of Duisburg, Germany. This early patent describes an articulated conveyor system for use in mining operations that can actually be moved within the mine to be near the mine face. But, the articulated conveyor system described in U.S. Pat. No. 4,332,317 cannot be automatically repositioned within the mine while the chain conveyor for moving mined material is actually moving the mined material out of the mine. Thus, the described articulated conveyor system described in U.S. Pat. No. 4,332,317 is incapable of remote operation.

U.S. Pat. No. 4,773,528 (Anderson, et al.) and U.S. Pat. No. 4,365,185 (Bodiner) assigned to Joy Technologies of Pittsburgh, Pa. describe an articulated conveyor system which can be repositioned within the mine at the same time a continuous conveyor belt is moving mined material out of the mine. The movement of the entire articulated conveyor system within the mine is facilitated by a plurality of framework members located under the continuous conveyor belt. Accordingly, the articulated conveyor system may be remotely operated. Steering of the articulated conveyor system is accomplished by the use of wheels on the input end of the conveyor system. In practice, it has been found that the inherent design and use of conveyor belt described in these two patents limits the total length of the articulated conveyor system to about 550 feet. Additionally, the length of the described conveyor system is limited as the tramming system described in U.S. Pat. Nos. 4,773,528 and 4,365,185 has difficulty negotiating multiple curves.

U.S. Pat. No. 5,096,048 (Lachner, et al.) assigned to Klockner-Becorit of Castrop-Rauxel, Germany is similar to U.S. Pat. No. 4,332,317, described above, in that the articulated conveyor system cannot be repositioned within the mine while the chain conveyor—for moving mined material—is actually moving mined material out of the mine. Movement of the articulated conveyor system within the mine is accomplished by dropping the chain conveyor down to the mine floor and then using the lower flight of the mined material movement chain as a tramming chain. Steering cylinders, located horizontally between separable segments of the conveyor support elements, allow the described articulated conveyor system to follow a path toward the mine face when the articulated conveyor system is repositioned within the mine.

U.S. Pat. No. 5,129,502 (Justice) assigned to Coaltex of Beckley, W. Va. describes a self-propelled articulated conveyor system. Mined material is moved away from the mine face through a tube by a long, continuous system of articulated augers. Repositioning or tramming of the entire articulated conveyor system within the mine is accomplished by the engagement of a conventional mining conveyor chain having transverse articulation interconnections between links with the mine floor. These transverse articulation interconnections allow the entire articulated conveyor system to follow a non-linear or curved pathway. The long, continuous system of articulating augers which is mounted over the conventional mining conveyor chain tramming system prohibits the use of the described system in thin coal seams; however, the entire articulated conveyor system can be moved to follow the mine face at the same time mined material is being taken out of the mine.

U.S. Pat. No. 5,634,545 (Plumley) assigned to Fairchild International of Glen Lyn, Va. describes a mobile articulated conveyor system in which a system of chain conveyor bridge sections are alternately placed on crawler-driven conveyor sections which engage the mine floor. The described articulated mobile conveyor system is designed to follow a continuous mining machine in room-and-pillar type mine configurations. The complex nature of the movement of the entire conveyor system requires that several operators in the mine to orchestrate the movements of the system to both position and re-position the bridge conveyor sections with respect to the crawler-driven chain conveyor sections.

Despite the improvements in mobile articulated conveyor systems described by the foregoing patents, a need still remains in the art for a mobile articulated conveyor system that is: a) capable of remote operation; b) will support the operation of a continuous miner in mines having thin seams of material; and c) is capable of conveying mined material while tramming or being repositioned to follow an active mine face. In addition, there is a need for a mobile articulated conveyor system: d) that is not length-limited; e) that can negotiate difficult steering patterns in underground mines; f) that can be easily converted from underground use to ground-level use; and g) that can be separated into individual sections to facilitate relocation and storage.

SUMMARY

The self-propelled, mobile articulated tramming haulage conveyor system of the present invention can be remotely repositioned to follow an automated continuous mining machine to provide an uninterrupted flow of mined substances from a borehole within a mine. Further, the self-propelled, mobile articulated tramming haulage conveyor system of the present invention is not length-limited, is able to negotiate difficult steering patterns in underground mines, can easily be converted from underground use to ground-level use and is easily stored and relocated.

Specifically, the self-propelled, mobile articulated tramming haulage conveyor system of the present invention for removing mined substances from a borehole within a mine, includes a continuous series of cascading mined material haulage chain conveyors mounted over one or more long continuous chain, conveyor system tramming apparatus or flexible crawlers. Alternatively a single mined or haulage chain conveyor may be mounted over a single flexible crawler. The long continuous chain, conveyor system tramming apparatus or flexible crawlers are constructed to fit under the of cascading mined material chain conveyor(s) and to provide the capability to continuously reposition the entire tramming haulage conveyor system. Specifically, when a continuous series of cascading mined material haulage chain conveyors are used, they are mounted over the one or more long continuous chain, conveyor system tramming apparatus or flexible crawlers such that movement of the one or more long continuous chain, conveyor system tramming apparatus or flexible crawlers will reposition the series of cascading mined material haulage chain conveyors within the borehole of a mine. Thus, as the entire self-propelled, mobile articulated tramming haulage conveyor system moves together with the automated continuous mining machine, a continuous flow of mined substances from an excavation from within the mine is provided as there is no need to temporarily stop mining operations to reposition the entire conveyor system.

BRIEF DESCRIPTION OF THE DRAWING FIGURES

A better understanding of the self-propelled, mobile articulated tramming haulage conveyor system for mining operations of the present invention may be had by reference to the drawing figures wherein:

FIGS. 8, 8A, 8B, and 8C are a top plan view of a grouser pad, a top plan view of the connector link, an exploded front elevational view, and an exploded side elevational view, respectively, of the grouser pad and connector link.

DESCRIPTION OF THE EMBODIMENTS

Figure 1:
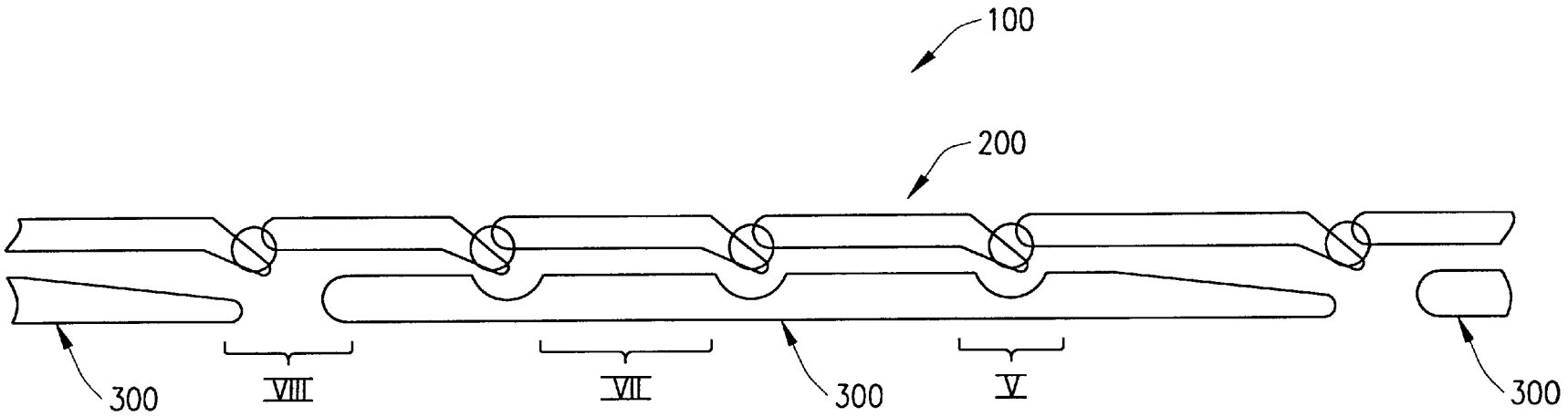
FIG. 1 is simplified schematic side elevational view of the tramming haulage conveyor of the present invention.

As shown in FIG. 1, the basic design of the self-propelled, mobile articulated tramming haulage conveyor 100 of the present invention combines a continuous series of cascading chain conveyor assemblies 200 with one or more long flexible continuous chain conveyor system tramming apparatus or flexible crawlers 300. In certain circumstances a single chain conveyor 200 may be used over single flexible crawler 300. Each one of the one or more long flexible continuous chain tramming or flexible crawlers apparatus may be up to about 300 feet in length for underground operation. Shorter flexible continuous chain tramming apparatus or flexible crawlers may be used for above ground mining operations. Further, as shown in FIG. 1, multiple long tramming apparatus or flexible crawlers 300 may be used under the continuous series of chain conveyor assemblies 200. The length of each one of the tramming apparatus or flexible crawlers 300 depends on the radii of the corners or bends to be traversed, the storage and relocation requirements placed on the system 100, and the power or energy available on the system.

Figure 2:
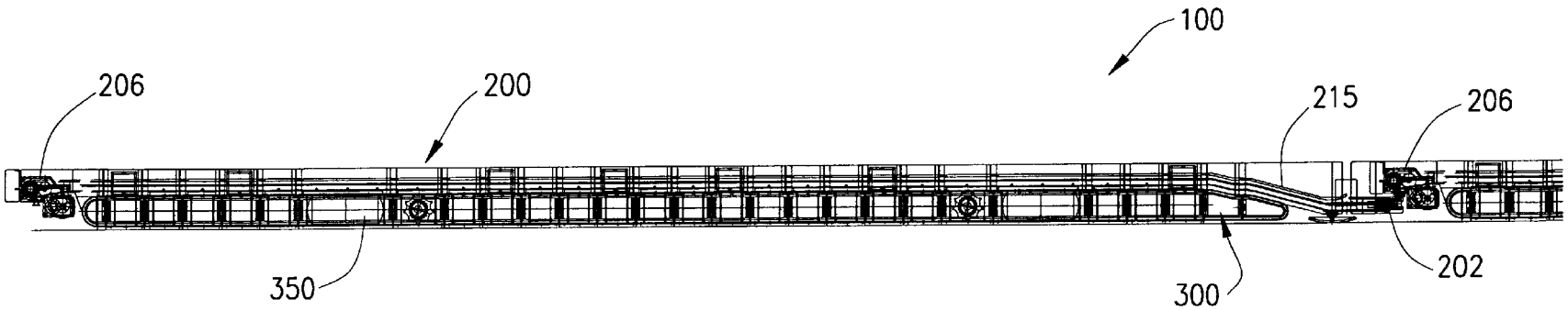
FIG. 2 is a side elevational view of the self-propelled, mobile, articulated tramming haulage conveyor system.
Figure 3:
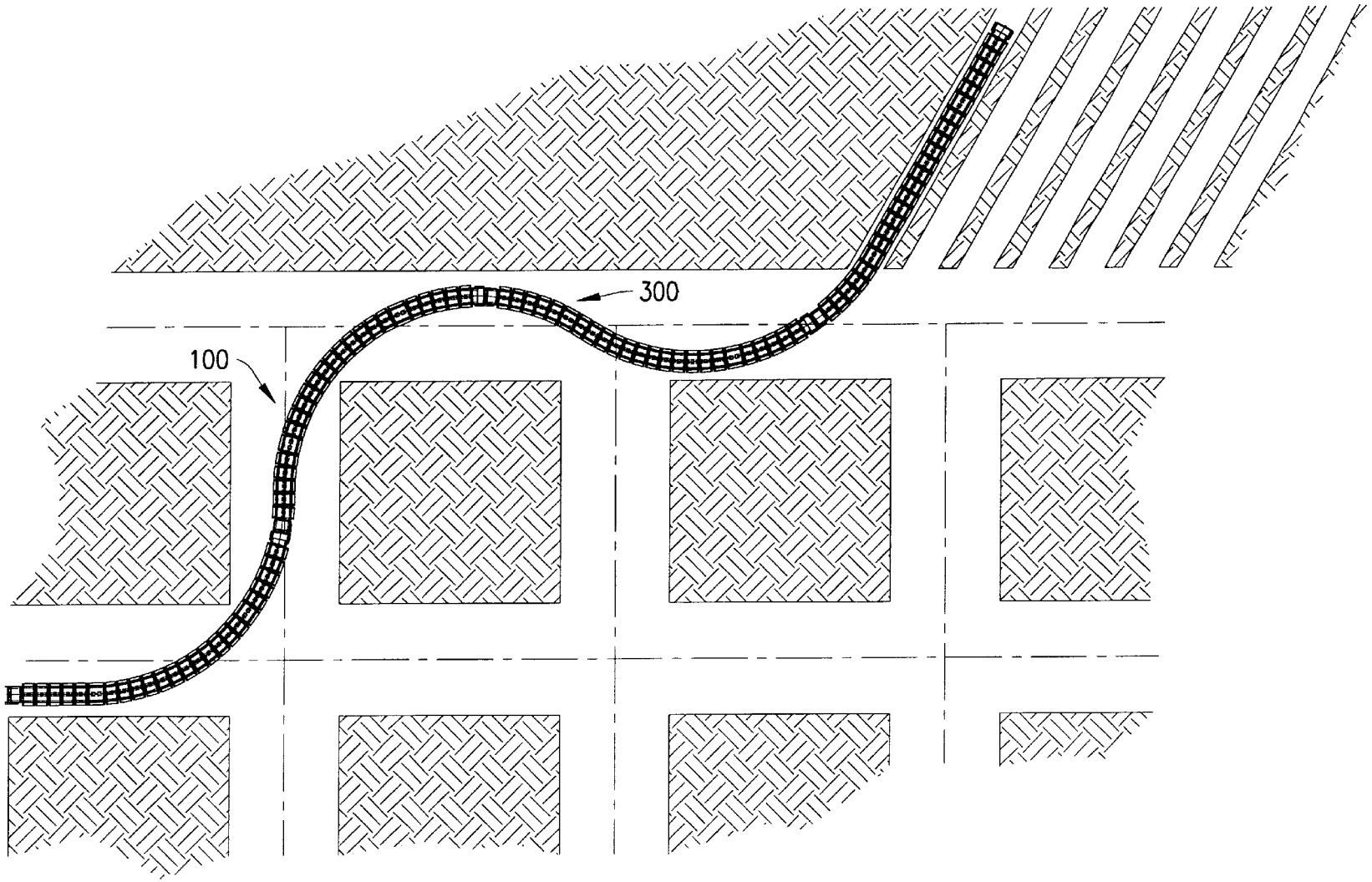
FIG. 3 is a top plan view of the self-propelled, mobile, articulated tramming haulage conveyor system in a "room and pillar" mine.

As shown in FIG. 2, the self-propelled, mobile articulated tramming haulage conveyor system 100 the continuous series of cascading chain conveyors 200 is mounted directly on top of the flexible continuous chain conveyor system tramming apparatus or flexible crawlers 300. By using a flexible frame assembly 50 (FIG. 4) to provide the mounting for the continuous series of cascading chain conveyors 200, a continuous flow of mined substances from the borehole of a mine can be achieved, even while the self-propelled, mobile articulated tramming haulage conveyor system 100 of the present invention is being repositioned within a "room and pillar" mine (FIG. 3).

Figure 4:
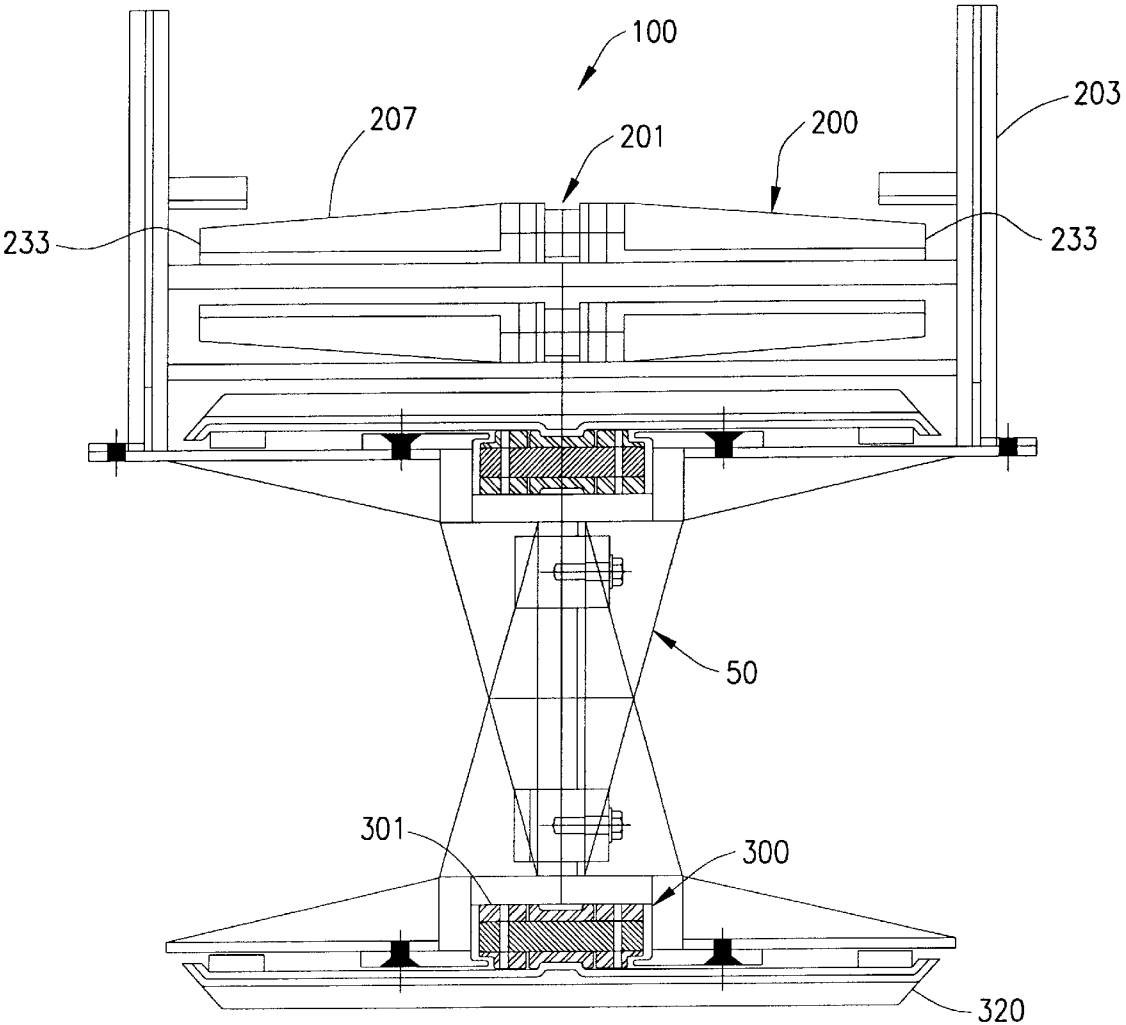
FIG. 4 is a front elevational view in partial section of the conveyor system.

As shown in FIG. 4, the continuous series of cascading chain conveyors 200 is located over the flexible continuous chain conveyor system tramming apparatus or flexible crawlers 300. Each chain conveyor within the continuous series of cascading chain conveyors 200 includes a central chain 201 having horizontally extending flight bars 207 spaced equally on the chain. Movement of mined substances along the top of each individual chain conveyor 200 toward the rear of the tramming haulage conveyor system 100 or in a direction into FIG. 4 removes mined substances from the borehole 1000. Sideboards 203 may be used to assist in retaining mined substances between the flight bars 207 on the individual chain conveyor 200.

It has been found that idler wheels (not shown) may be mounted on the tips 233 of the flight bars 207 so that when the tips 233 of the flight bars 207 contact the sidewall 203 of the individual chain conveyors 200, there will only be rotating friction between the tips 233 of the flight bars 207 and the sidewalls 203.

Located at the bottom of the self-propelled, mobile articulated tramming haulage conveyor 100 are the one or more long flexible continuous chain conveyor system tramming apparatus or flexible crawlers 300. The one or more long continuous chain conveyor system tramming apparatus or flexible crawlers include a conventional mining conveyor chain 301, such as those sold by the Cincinnati Mine Machinery Company of Cincinnati, Ohio under the trade name "Cincinnati Conveyor Chains". Such chains include transverse articulation interconnections between the links. The construction of such chains permit them to follow a non-linear, and, in fact, even a curved, pathway. In essence, the chain 301, when in contact with the mine floor, acts as a single crawler mechanism for transporting the flexible frame assembly 50. In this way, the chains are similar, per se, to the self-propelled conveyor drives utilized by Klockner-Becorit GmbH of Rackinghausen, Germany, for their conveyor which is called a"Self-Propelled Conveyor With an Intermediate Drive". However, distinct from the Klockner-Becorit drive mechanism, the chain 301 and grouser pad 312 used in the present invention does not need to be raised off the floor of the mine to provide for continuous movement of the entire conveyor assembly 100 irrespective of the movement of the continuous series of cascading chain conveyors 200.

The individual flight bars 320 attached to the central chain 301 on the flexible track frame moving apparatus 300 may optionally include spring loaded hinges if the floor of the mine is curved or channeled.

As shown in FIGS. 8, 8A, 8B, and 8C, the flat grouser pad 312 is mounted on a central connector link 335 in the central tramming chain 301 using a square post 333. The square post 333 extends upwardly from the central connector link 335 into a square mounting hold 314 in the flat, grouser pad 312. The grouser pad 312 itself rests on a ledge 337 which surrounds the bottom of a square post 338.

Figure 5:
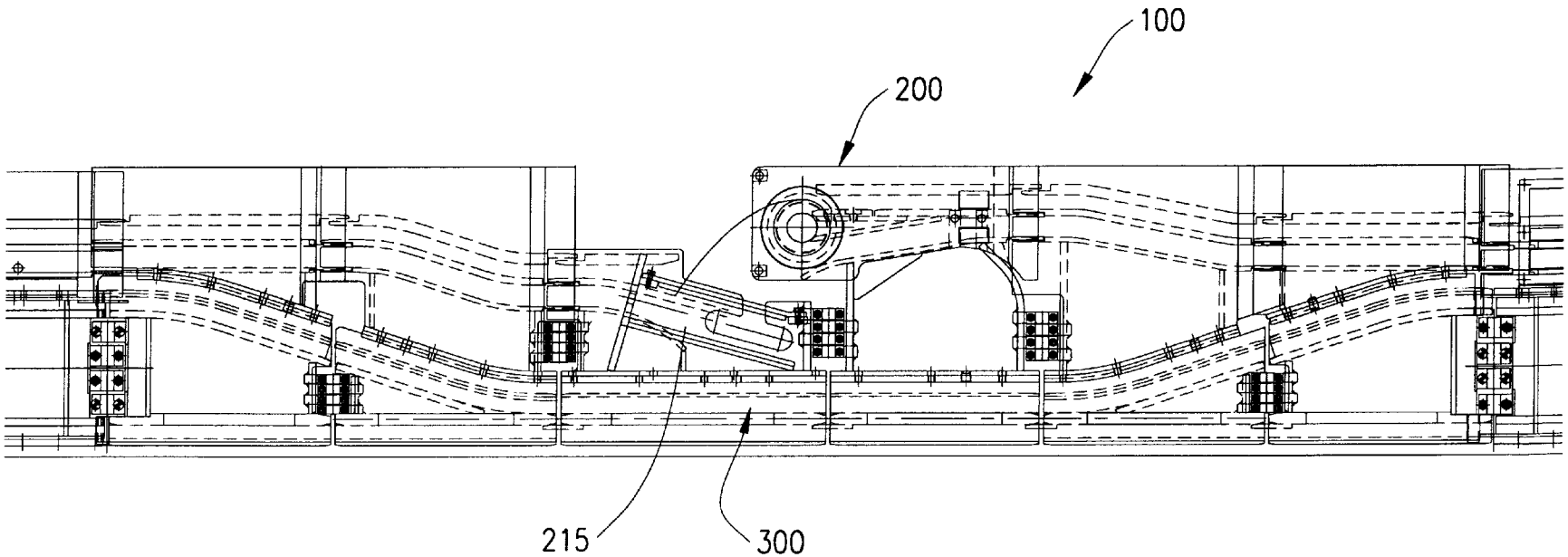
FIG. 5 is a side elevational view generally at location V in FIG. 1.
Figure 6:
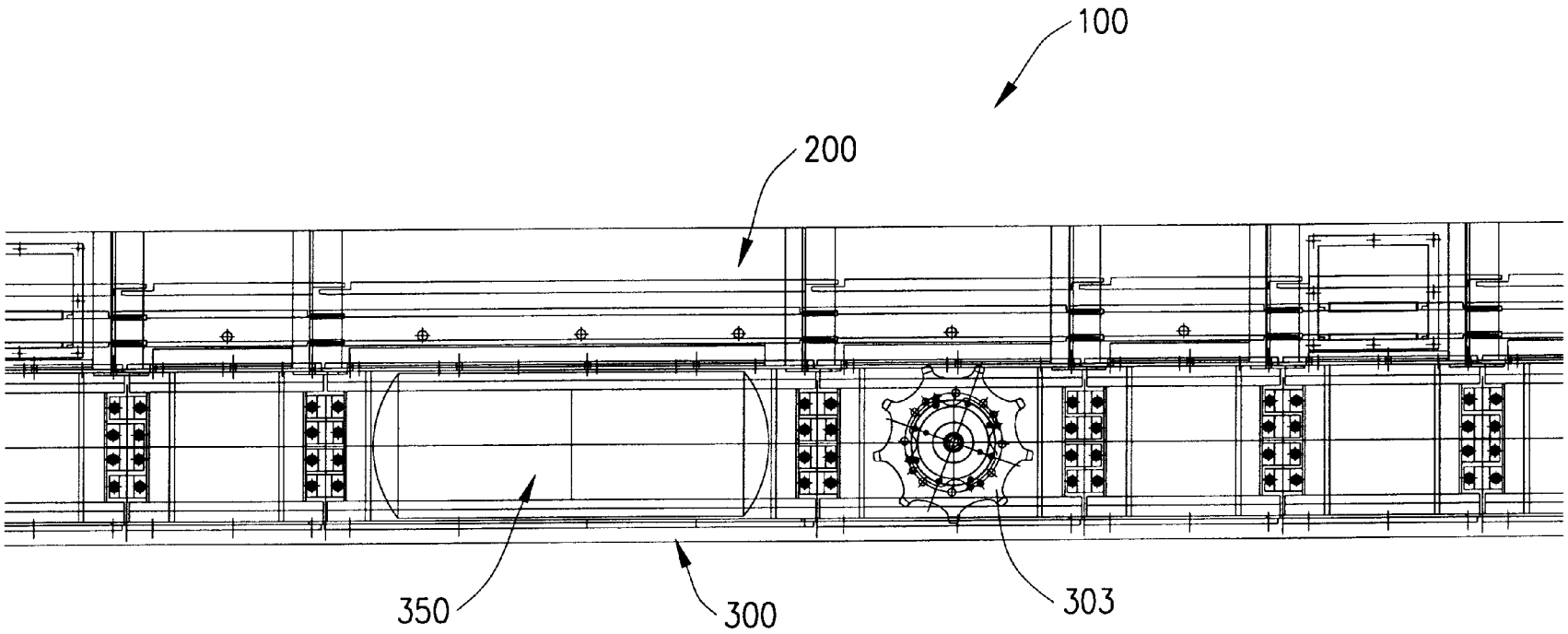
FIG. 6 is a side elevational view generally at location VI in FIG. 1.
Figure 7:
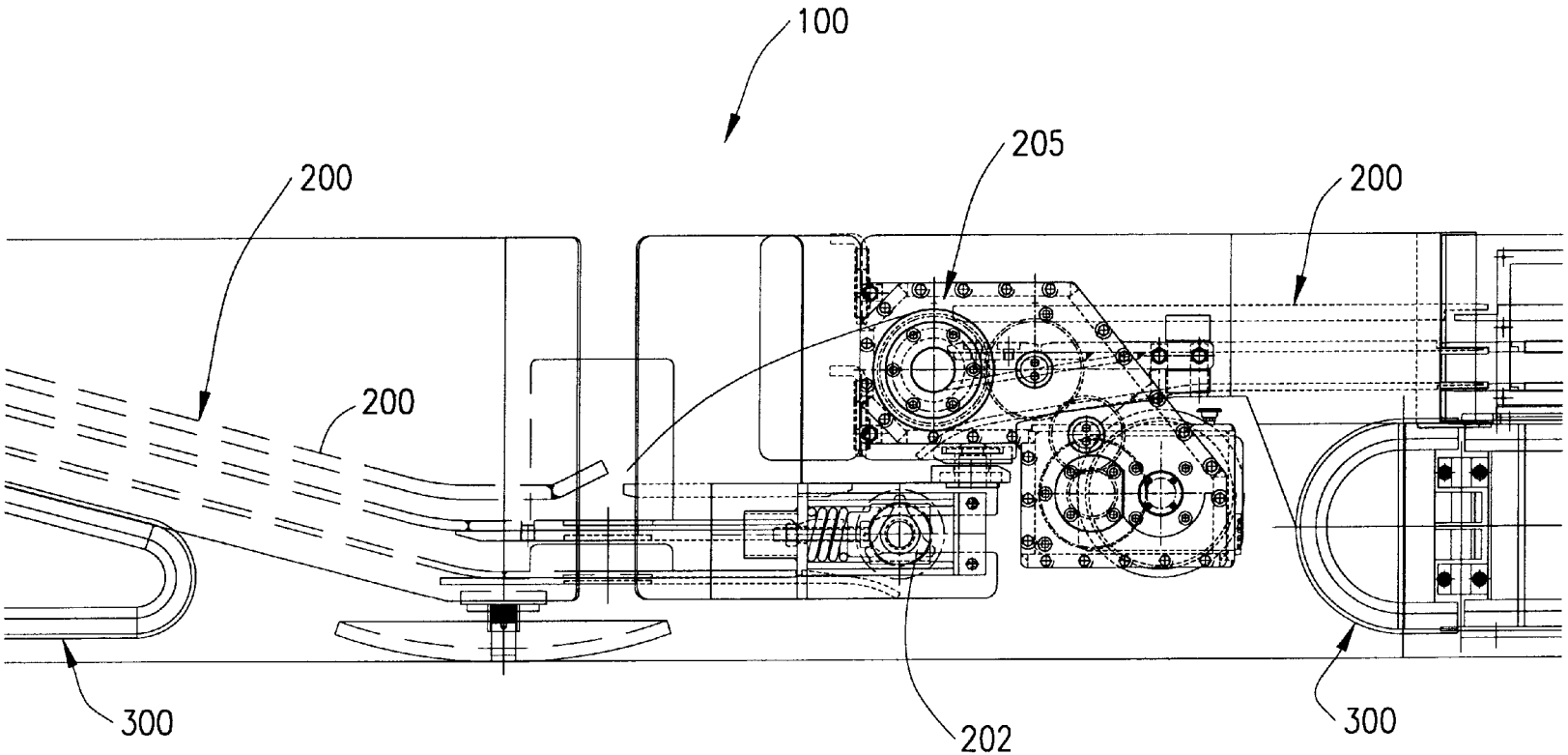
FIG. 7 is a side elevational view generally at location VII in FIG. 1.

A still better understanding of the tramming haulage conveyor system of the present invention 100 may be had by comparing the side elevational views in FIGS. 5, 6, and 7 which correspond to numbers V, VI, and VII in FIG. 1. In FIG. 5, the overlap of individual chain conveyors within the continuous series of cascading chain conveyors 200 is shown. This overlap is located over that portion of the continuous chain tramming conveyor or flexible crawler 300 which dips down to accommodate the overlap between individual cascading chain conveyors. In FIG. 6, that section of an individual chain conveyor is shown which is in between the overlapping portion of the individual chain conveyors. Once again, the long continuous chain tramming conveyor or flexible crawler 300 is shown. Note the large drive sprocket 303 which is used to move the continuous chain tramming conveyor or flexible crawler 300. In FIG. 7 is shown the overlap between individual sections of the chain conveyor at the end of one of the continuous chain tramming conveyor apparatus or flexible crawler 300.

As may be seen in FIG. 7 and as will be understood by those of ordinary skill in the art, the flexible crawlers 300 are joined together at a vertical connection similar to a fifth wheel connection similar to that used between tractors and semi-trailers.

Figure 7A:
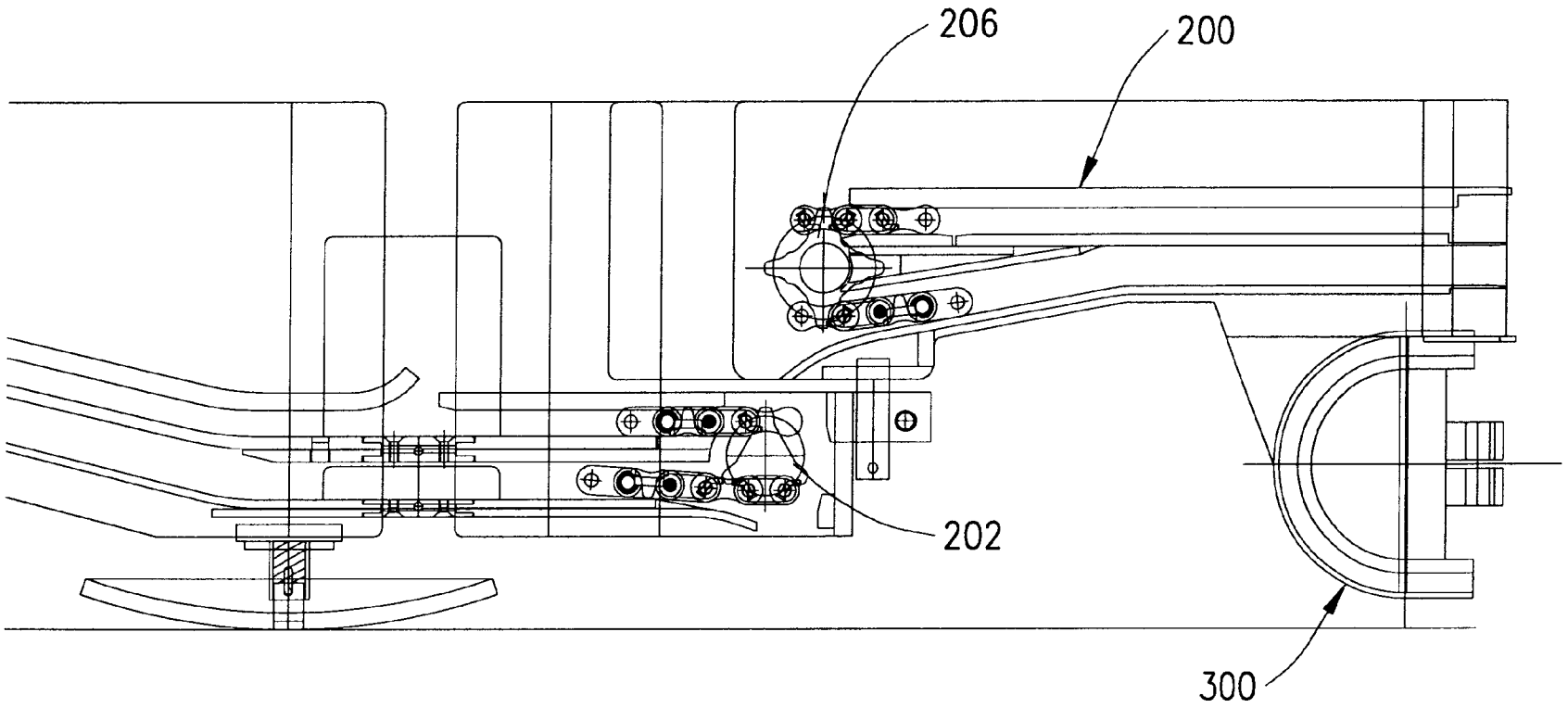
FIG. 7A is a side elevational view similar to FIG. 7 with the gear box removed to show the conveyor drive sprocket.
Figure 8A:
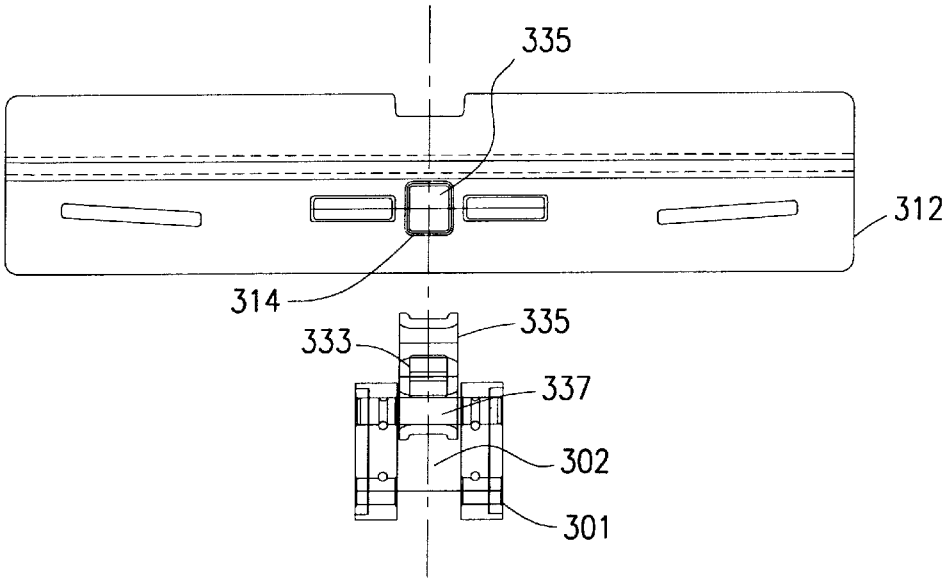
Figure 8B:
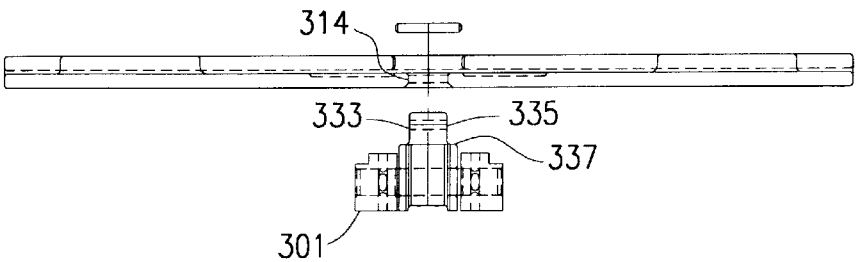
Figure 8C:
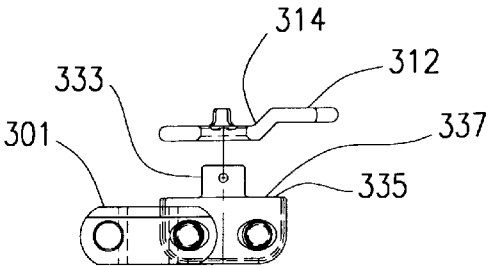

As shown in FIG. 7A, each individual conveyor within the continuous series of cascading chain conveyors 200 is driven by a drive sprocket 206. The drive sprocket 206 is driven by a motor-transmission and a gear box assembly 205 (FIG. 7). An idler sprocket 202 allows each of the individual cascading chain conveyors to continuously convey mined material out of the borehole. Extending upwardly from idler sprocket 202 is a slant section 215. The slant section 215 receives material falling from the rear portion of the next forward individual cascading chain conveyor.

Alternatively, as will be understood by those of ordinary skill in the art, the self-propelled, mobile articulated tramming haulage conveyor system of the present invention may be fabricated by simply stacking one continuous chain tramming apparatus or flexible crawler over another continuous chain tramming apparatus or flexible crawler.

By placing a special "take up" on the idler sprocket 202, constant tension on the central chain 201 can be maintained irrespective of the curvature of the tramming haulage conveyor system 100 as it passes through a mine.

Also shown in FIG. 6 is the hub/sprocket 303 for the continuous chain, conveyor system tramming apparatus or flexible crawlers 300. The hub/sprocket 303 engages the central chain 301 (FIG. 4) and receives rotational drive power from a hydraulic pump motor power system 350. As the hub/sprocket 303 rotates in a clockwise direction, the tramming haulage conveyor system 100 moves forward or to the right side of FIG. 6. If the hub/sprocket 303 is caused to rotate in a counter-clockwise direction, the tramming haulage conveyor system 100 will move in the opposite direction or to the left side of FIG. 6. Such movement may occur while the continuous series of cascading chain conveyor segments is in operation.

The tramming haulage conveyor system 100 of the present invention can be accurately steered regardless of its length. Such steering is provided by steering cylinders (not shown) which are located on each flexible crawler 300. These steering cylinders horizontally adjust the angle between each portion of the flexible frame assembly 50 on which the continuous series of cascading chain conveyors 200 is mounted. The angle between each portion of the flexible frame 50 establishes the advancement direction of the entire conveyor system 100. As the track frame moving apparatus or flexible crawlers 300 are hydraulically powered, the speed and direction of the flexible continuous chain, conveyor system tramming apparatus or flexible crawlers 300 for both entry into and exit from a borehole within a mine can be easily controlled. Such conveyor speed can be infinitely varied or controlled.

The entire tramming haulage conveyor system is coupled together mechanically and electrically to produce a conveyor system with a cascading material flow. Such a system of segments, coupled together mechanically and electrically, would be thoroughly capable of following a continuous type mining machine irrespective of the mining method used. Furthermore, the speed of the individual tramming and haulage conveyors can be variable to allow flexibility for a variety of applications. As previously indicated, the tramming conveyor would be steered past corners and bends within a borehole by steering cylinders located on each segment. In the preferred embodiment, these steering cylinders are hydraulically controlled and double acting.

Those of ordinary skill in the art will understand that the tramming haulage conveyor system of the present invention may be used in either above-ground or below-ground mining operations. Further, the tramming haulage conveyor system may be freely manipulated so that the entire conveyor system can be both propelled in a multitude of directions and easily be positioned to negotiate corners or bends within a borehole.

While the invention has been explained with reference to its preferred and alternate embodiments, those of ordinary skill will understand that numerous other embodiments of the present invention are enabled from the foregoing disclosure. Such other embodiments shall be included within the scope and meaning of the appended claims.

What is claimed is:

1. A self-propelled, mobile articulated conveyor system comprising:

at least one chain conveyor;

said at least one chain conveyor mounted over and positioned by a flexible continuous chain, tramming apparatus or flexible crawler; and wherein the conveyor system may be freely manipulated so that the entire conveyor system can be propelled in a multitude of directions and easily be positioned to negotiate corners or bends.

2. The system as defined in claim 1 wherein said continuous chain, tramming apparatus or flexible crawler is constructed and arranged to negotiate bends within the borehole of a mine.

3. The system as defined in claim 1 wherein said flexible crawler has a variable speed.

4. The system as defined in claim 1 wherein said continuous chain, tramming apparatus or flexible crawler includes a central chain having flight bars.

5. A self-propelled, mobile articulated conveyor system comprising:

a plurality of conveyor segments, each conveyor segment including;

said at least one chain conveyor being mounted over and positioned by a continuous chain, tramming apparatus or flexible crawler;

wherein said flexible crawler has a variable speed.

6. The system as defined in claim 5 wherein said continuous chain, tramming apparatus or flexible crawler is constructed and arranged to negotiate bends within the borehole of amine.

7. The system as defined in claim 5 wherein said continuous chain, tramming apparatus or flexible crawler includes a central chain having flight bars.

8. A self-propelled, mobile articulated conveyor system for removing materials from a borehole within a mine, said self-propelled, mobile articulated conveyor system comprising:

a continuous plurality of cascading individual chain conveyors for moving materials away from a mine face;

a flexible frame for supporting said plurality of cascading chain conveyors;

a continuous chain tramming apparatus or crawler for moving said continuous plurality of cascading chain conveyors;

whereby materials may be removed from the borehole within the mine while the continuous chain tramming apparatus is moving within the borehole.

9. The system as defined in claim 8 wherein each of said continuous plurality of cascading chain conveyors is enclosed by sidewalls.

10. The system as defined in claim 8 wherein said flexible track frame is articulated by substantially horizontally mounted cylinders to negotiate turns in the borehole.

11. The system as defined in claim 8 wherein said continuous chain tramming apparatus or flexible crawler includes hinged flight bars to allow for passage over a curved floor.

12. The system as defined in claim 8 wherein said continuous chain tramming apparatus or flexible crawler has a variable speed.

13. The system as defined in claim 8 wherein said plurality of cascading chain conveyors further includes a plurality of flight bars.

14. The system as defined in claim 8 wherein said plurality of cascading chain conveyors have fixed or variable speed.

15. The conveyor system as defined in claim 8 wherein said continuous chain tramming apparatus is a single articulating flexible crawler.

16. A self-propelled, mobile articulated conveyor system comprising:

two continuous chain tramming apparatus or flexible crawlers assembled vertically, one on top of the other, wherein said top flexible crawler acts as chain conveyor and said bottom flexible crawler functions as tramming apparatus.

* * * * *

UNITED STATES PATENT AND TRADEMARK OFFICE

CERTIFICATE OF CORRECTION

PATENT NO. : 6,283,277 B1
DATED : September 4, 2001
INVENTOR(S) : Gregory W. Smith et al.

It is certified that error appears in the above-identified patent and that said Letters Patent is hereby corrected as shown below:

Title page,
Assignee [73], delete "?" and replace with -- , --

Signed and Sealed this

Fourteenth Day of May, 2002

*Attest:*

*Attesting Officer*

JAMES E. ROGAN
*Director of the United States Patent and Trademark Office*